US009196441B2

(12) United States Patent
Wilson

(10) Patent No.: US 9,196,441 B2
(45) Date of Patent: Nov. 24, 2015

(54) MODULAR RELAY SUB-ASSEMBLY

(71) Applicant: ABL IP Holding LLC, Lithonia, GA (US)

(72) Inventor: John David Wilson, Shadow Hills, CA (US)

(73) Assignee: ABL IP Holding LLC, Conyers, GA (US)

( * ) Notice: Subject to any disclaimer, the term of this patent is extended or adjusted under 35 U.S.C. 154(b) by 0 days.

(21) Appl. No.: 14/256,637

(22) Filed: Apr. 18, 2014

(65) Prior Publication Data

US 2014/0312998 A1 Oct. 23, 2014

Related U.S. Application Data

(60) Provisional application No. 61/814,083, filed on Apr. 19, 2013.

(51) Int. Cl.

| | |
|---|---|
| ***H01H 13/04*** | (2006.01) |
| ***H01H 45/04*** | (2006.01) |
| ***H01H 50/14*** | (2006.01) |
| *H01H 71/02* | (2006.01) |
| *H01H 71/08* | (2006.01) |

(52) U.S. Cl.

CPC ..... *H01H 45/04* (2013.01); *H01H 50/14* (2013.01); *H01H 71/0271* (2013.01); *H01H 71/082* (2013.01); *H01H 2071/0278* (2013.01); *Y10T 29/49105* (2015.01)

(58) Field of Classification Search

CPC ..... H01H 1/58; H01H 1/04; H01H 1/45; H01H 9/26; H01H 2009/265

USPC ..... 335/202

See application file for complete search history.

(56) References Cited

U.S. PATENT DOCUMENTS 3,160,730 A * 12/1964 Jakel ..... 200/281
3,255,330 A 6/1966 MacKenzie et al.

(Continued)

FOREIGN PATENT DOCUMENTS

| | | |
|---|---|---|
| DE | 9421856 | 11/1996 |
| FR | 2730855 | 8/1996 |

OTHER PUBLICATIONS

Extended European Search Report for European Application No. EP 141654486.3, mailed Aug. 8, 2014, 9 pages.

*Primary Examiner* — Shawki S Ismail
*Assistant Examiner* — Lisa Homza
(74) *Attorney, Agent, or Firm* — Kilpatrick Townsend & Stockton, LLP

(57) ABSTRACT

A modular relay sub-assembly is provided. The modular relay sub-assembly can include a first housing portion, a second housing portion, a conductor having a first contact, and a split conductor. The second housing portion may be attached to a surface of the first housing portion. The conductor may be disposed inside a cavity formed by the two housing portions. The first contact may be accessible through a first opening in the first housing portion. The split conductor may include a first portion, a second portion, and a contact. The split conductor being disposed inside the cavity formed by the first and second housing portions. The second portion may be disposed at a position electrically isolated from the first portion. The contact of the split conductor can be accessible through a second opening in the first housing portion. The split conductor can be positioned to selectively contact the conductor.

8 Claims, 7 Drawing Sheets

(56) References Cited

U.S. PATENT DOCUMENTS

| | | | | |
|---|---|---|---|---|
| 3,800,252 | A * | 3/1974 | Aigner | 335/135 |
| 4,075,446 | A * | 2/1978 | Aadahl | 218/155 |
| 4,191,871 | A * | 3/1980 | Coyle | 200/530 |
| 4,533,889 | A | 8/1985 | Knight | |
| 7,116,194 | B2 * | 10/2006 | Azzola et al. | 335/202 |
| 7,679,478 | B2 | 3/2010 | McCoy | |
| 2004/0000469 | A1 * | 1/2004 | Gibson et al. | 200/400 |
| 2006/0132269 | A1 | 6/2006 | Kadah | |
| 2007/0063796 | A1 | 3/2007 | Mattlar et al. | |
| 2008/0135390 | A1 | 6/2008 | McCoy | |
| 2011/0156610 | A1 | 6/2011 | Ostrovsky et al. | |
| 2014/0246299 | A1 * | 9/2014 | Hollner et al. | 200/5 A |

* cited by examiner

MODULAR RELAY SUB-ASSEMBLY

CROSS-REFERENCE TO RELATED APPLICATIONS

This application claims priority to U.S. Provisional Application Ser. No. 61/814,083 filed Apr. 19, 2013 and titled "Modular Relay Sub-Assembly," the contents of which are hereby incorporated by reference.

FIELD OF THE INVENTION

The present invention is directed to relay devices and more particularly relates to a modular relay sub-assembly that can include a split conductor.

BACKGROUND

The installation of electrical wiring and equipment may involve installing electromechanical relays in a building or other structure. Electromechanical relays are used to switch electrical circuits between different states. For example, an electromechanical relay may include a switch in an electrical circuit that is used to switch the electrical circuit between an "ON" state in which current flows through the electrical circuit and an "OFF" state in which no current flows through the electrical circuit.

In the context of relays, varying needs for relays may require different types of assemblies or the addition of auxiliary equipment in order to fulfill the demand for additional functionality in various control systems. For example, features such as current sensing, phase dimming, and 0-10V dimming may require low-voltage data that monitors or controls the current of load devices that are connected to a control relay to accomplish an intelligent and energy efficient management system. Such requirements often require specialized or individual devices, add-on auxiliary equipment, and/or relay configurations of different designs dedicated for each purpose.

It is desirable to provide a modular relay sub-assembly that can allow for alternate configurations of components for different deployment environments.

SUMMARY

In some aspects, a modular relay sub-assembly is provided. The modular relay sub-assembly can include a first housing portion, a second housing portion, a conductor having a first contact, and a split conductor. The second housing portion may be attached to a surface of the first housing portion. The conductor may be disposed inside a cavity formed by the two housing portions. The first contact may be accessible through a first opening in the first housing portion. The split conductor may include a first portion, a second portion, and a contact. The split conductor being disposed inside the cavity formed by the first and second housing portions. The second portion may be disposed at a position electrically isolated from the first portion. The contact of the split conductor can be accessible through a second opening in the first housing portion. The split conductor can be positioned to selectively contact the conductor.

In other aspects, a method for manufacturing a relay having a modular design is provided. The method can involve selecting a first portion of a split conductor defining a first terminal and a second portion of the split conductor defining a second terminal. The method can also involve positioning the first portion inside a first housing portion. The method can also involve positioning the second portion inside the first housing portion at a position electrically isolated from the first portion. The method can also involve selecting a second housing portion defining a first opening and a second opening. The method can also involve attaching the first housing portion to the second housing portion such that the first and second terminals protrude through the openings.

These and other aspects, features and advantages of the present invention may be more clearly understood and appreciated from a review of the following detailed description and by reference to the appended drawings and claims.

DETAILED DESCRIPTION

Figure 1:
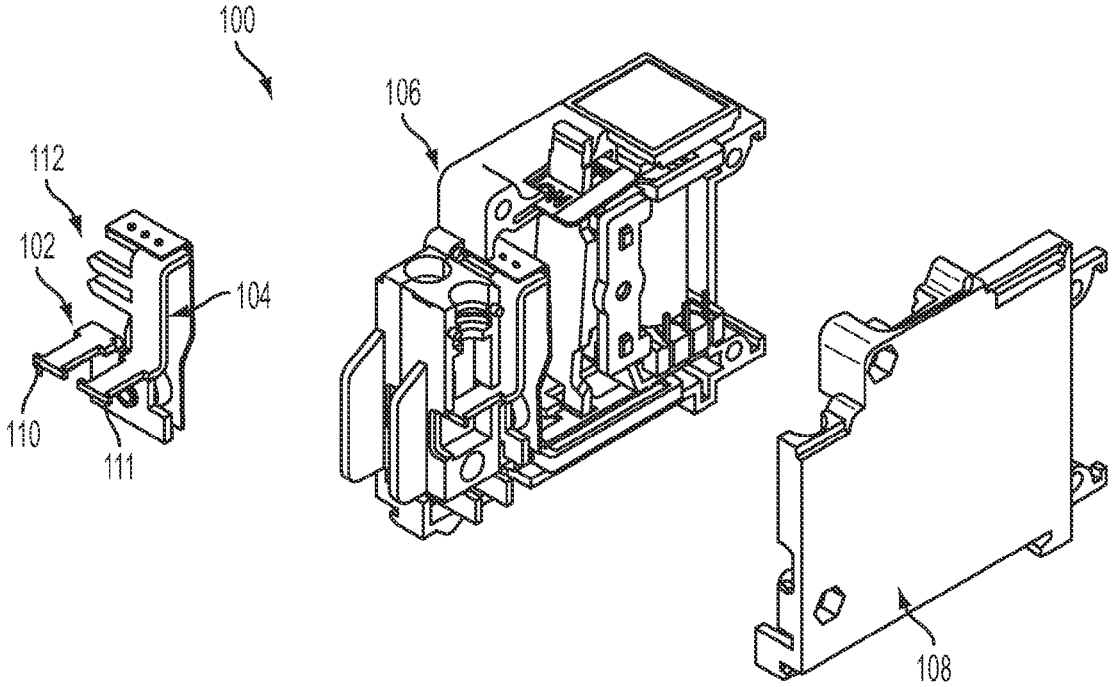
FIG. 1 is an exploded view depicting an example of a relay assembly.

Certain aspects of the invention provide a modular relay sub-assembly usable in multiple configurations that can be used for lighting control or other electrical control applications. The modular relay sub-assembly can include a relay having a split conductor for one or more conductive components of the relay. The split conductor includes terminals that extend outside the casing or other housing enclosing the relay for forming an electrical connection. The modular relay sub-assembly can be used as a stand-alone relay assembly or a relay assembly including one or more auxiliary devices. The modular relay sub-assembly is designed to either provide a stand-alone relay or accommodate additional components (e.g., circuit monitoring or processing modules) that add functionality to the base relay module. Non-limiting examples of such auxiliary devices include circuit monitoring and/or processing modules adding additional functionality to the relay module.

Different configurations of the modular relay sub-assembly may be used to implement different types of functionality in lighting control systems and/or other electrical systems. For example, features such as (but not limited to) current sensing, phase dimming, and 0-10 volt dimming may involve using low-voltage data to monitor and/or control the current of load devices that are connected to a lighting control relay.

Monitoring and/or controlling the current of such load devices can allow for an intelligent and energy efficient lighting management system or other electrical control system. Implementation of such features may involve using different devices, different add-on auxiliary equipment, and/or different relay assemblies having different designs dedicated for each purpose.

In some aspects, a modular relay sub-assembly can be manufactured in a manner that allows for utilizing multiple relay assembly configurations that are interchangeable. A base relay can be manufactured in higher volumes to accommodate the additional options with terminals provided by the split conductor. The relay sub-assembly can include a housing portion that is adapted to provide terminal openings through which the terminals can protrude. The housing portion can also include mounting bosses or other suitable protrusions to which auxiliary devices and/or additional modules can be attached or otherwise coupled. These aspects can provide a low-cost manufacturing method, eliminate the need for supplemental equipment, and/or provide a common form-factor component that can be utilized in the same equipment enclosures.

In some aspects, a first configuration of a modular relay sub-assembly can allow for routing a line or load current through an auxiliary circuit for processing or monitoring, (e.g., current sensing, phase dimming, and the like). In a second configuration of the modular relay sub-assembly, the relay may be configured for operation without routing of a line or load current through an auxiliary circuit. The first configuration may involve using a split conductor design that includes a first portion, a second portion, and a second contact. The split conductor may be disposed inside a cavity formed by the first housing portion and the second housing portion such that the second portion is disposed at a position electrically isolated from the first portion. The second contact may be accessible through a second opening in the first housing portion and the split conductor may be positioned to selectively contact the conductor. In addition, the first portion of the split conductor may include a first terminal, the second portion of the split conductor may include a second terminal, and the conductor may include a third terminal. The terminals may allow the current to be routed from the relay to an attachable auxiliary device outside the relay casing. The second configuration can involve using two standard conductors (i.e., no split conductor) where there are no terminals extending outside the casing of the relay assembly.

A modular relay sub-assembly can allow a sensing element to be positioned outside a casing or other housing enclosing a relay. Positioning a sensing element outside the casing of the relay can prevent damage to the sensing element. For example, mounting a sensing element, such as a ceramic resistor, within two metal connectors inside the relay casing can increase the likelihood of the ceramic resistor being damaged by expansion of the metal connectors caused by heating of the metal connectors conducting current. Positioning a sensing element such as (but not limited to) a resistor outside the casing of the relay can prevent damage to the sensing element by allowing an external heat sink to contact the probes.

The subject matter of aspects of the present invention is described here with specificity to meet statutory requirements, but this description is not necessarily intended to limit the scope of the disclosed subject matter. The disclosed subject matter may be embodied in other ways, may include different elements or steps, and may be used in conjunction with other existing or future technologies. This description should not be interpreted as implying any particular order or arrangement among or between various steps or elements except when the order of individual steps or arrangement of elements is explicitly described.

FIG. 1 is an exploded view of a relay 100 having standard contact conductors 102, 104. Conductor 102 may have a contact 110 and conductor 104 may have a contact 111. The relay 100 can also include a first housing portion 106 and a second housing portion 108.

Figure 2:
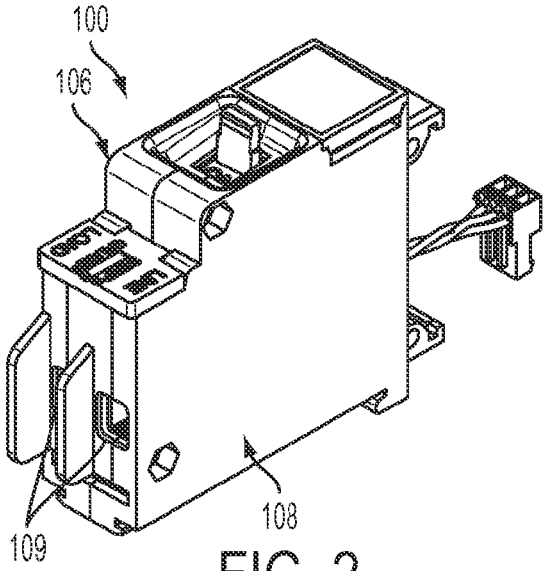
FIG. 2 is a perspective view depicting the relay assembly of FIG. 1 shown assembled.
Figure 3A:
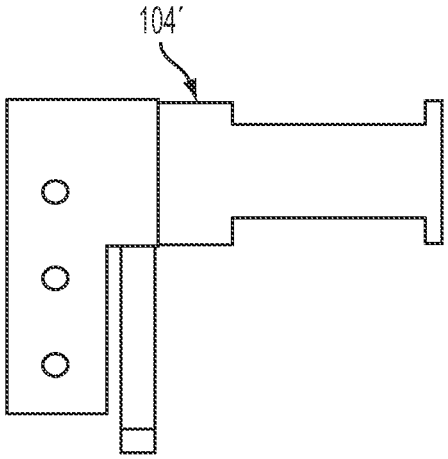
FIGS. 3A and 3B are vertical and lateral views, respectively, depicting an example of a conductor that can be included in a relay sub-assembly.
Figure 3B:
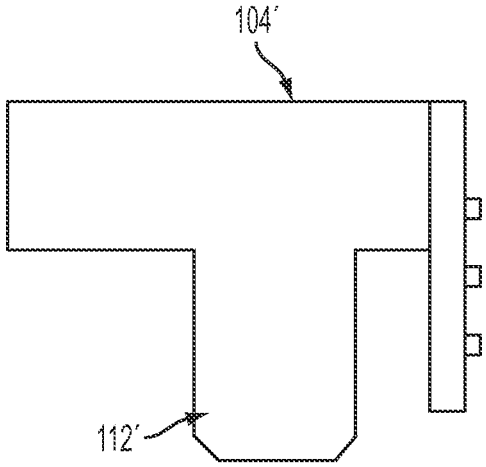

FIG. 2 is a perspective view of the assembled relay 100. The first housing portion 106 and second housing portion 108 can be coupled together or otherwise attached via any suitable mechanism and/or process. For example, the first housing portion 106 and second housing portion 108 can be coupled together or otherwise attached by a suitable adhesive material and/or by using fastening devices such as screws, bolts, etc. The conductors 102, 104 can be positioned within a cavity inside the first housing portion 106. The cavity can be formed by attaching or otherwise coupling the first housing portion 106 and second housing portion 108. The assembly may include one or more openings 109 that provide access to the conductors, such as to contact 110 and/or contact 111. FIG. 3A is a vertical view of an alternative implementation of a conductor 104'. FIG. 3B is a lateral view of the alternative conductor 104'.

The conductors 102, 104 can be formed from a suitable conductive material, such as (but not limited to) copper. The conductor 104 can include one or more tangs 112 or other extended portions of the conductor 104 that can be used to maintain the conductor 104 in a stable position inside the casing. The conductor 104 can be a single, integral conductor that can be movably positioned in the relay 100 to selectively contact the conductor 102. Contact between the conductors 102, 104 can actuate the relay.

Figure 4:
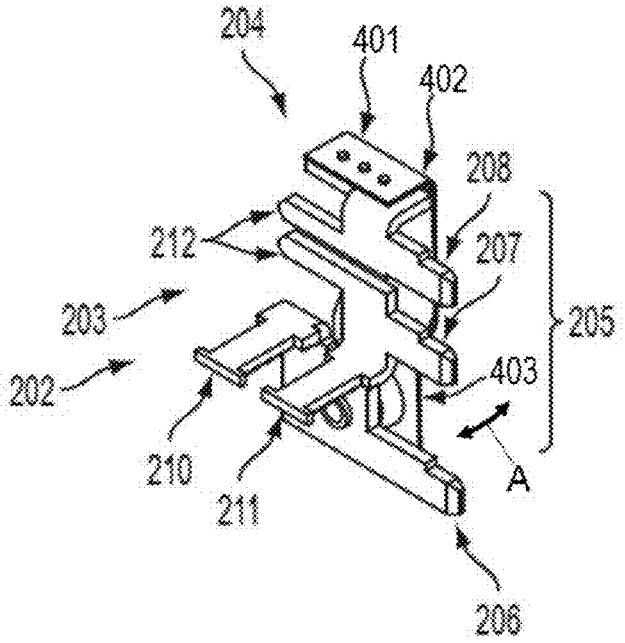
FIG. 4 is a perspective view depicting a conductor and a split conductor that can be included in a modular relay sub-assembly.
Figure 5A:
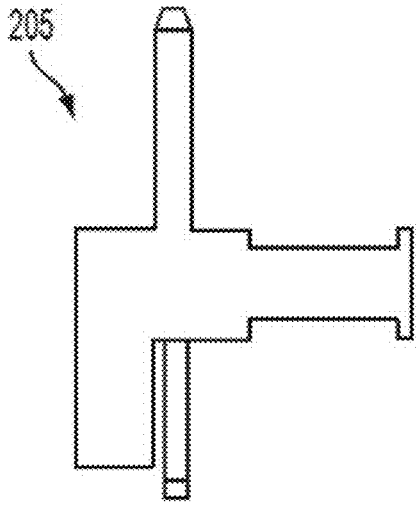
FIGS. 5A and 5B are vertical and lateral views, respectively, of a split conductor that can be included in a modular relay sub-assembly.
Figure 5B:
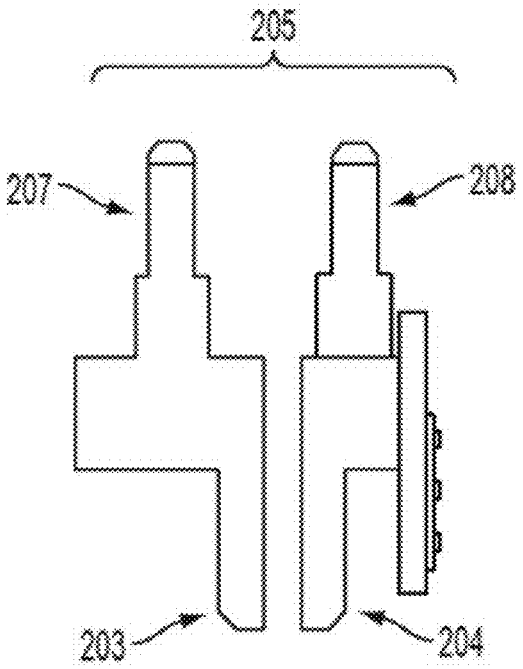

A modular relay sub-assembly can be provided by replacing the integral conductor 104 with a split conductor 205, as depicted in FIGS. 4-5. FIG. 4 is a perspective view of a conductor 202 and a split conductor 205 usable in a modular relay sub-assembly. FIG. 5A is a vertical view of the split conductor 205. FIG. 5B is a lateral view of the split conductor 205.

The split conductor 205 can include a first portion 203 and a second portion 204. In some aspects, the one or more tangs 212 or other extended portions of a conductor can be split or otherwise separated to form the first portion 203 and the second portion 204. The first portion 203 and the second portion 204 can be formed from a suitable conductive material, such as (but not limited to) copper. The split conductor 205 may include a moveable contact arm 401 with an upper portion 402 attached to the second portion 204 such that the moveable contact arm 401 can be movably positioned such that a lower portion 403 of the moveable contact arm 401 may pivot about the upper portion 402 and travel along an arc path A and selectively contact the conductor 202. In the OFF condition, the lower portion 403 does not contact conductor 202. In the ON condition, the lower portion 403 (due to the mechanism connected to the switch in FIG. 6) moves along arc path A to contact the conductor 202 and completes the circuit between the split conductor 205 and the conductor 202. Conductor 202 may have a contact 210 and split conductor 205 may have a contact 211.

The split conductor 205 can be formed with terminals or other contact portions that extend outside the casing of a modular relay sub-assembly. The first portion 203 can be formed to include a terminal 207 adapted to protrude from the casing of a relay. The second portion 204 can be formed to include a terminal 208 adapted to protrude from the casing of a relay. The first portion 203 and second portion 204 providing the split conductor 205 can be separated by an air gap or a suitable non-conducting material. The first portion 203 and second portion 204 providing the split conductor 205 can be formed from copper or another suitable conductive material.

The conductor 202 can be formed to include a terminal 206 adapted to protrude from the casing of a relay.

Figure 6:
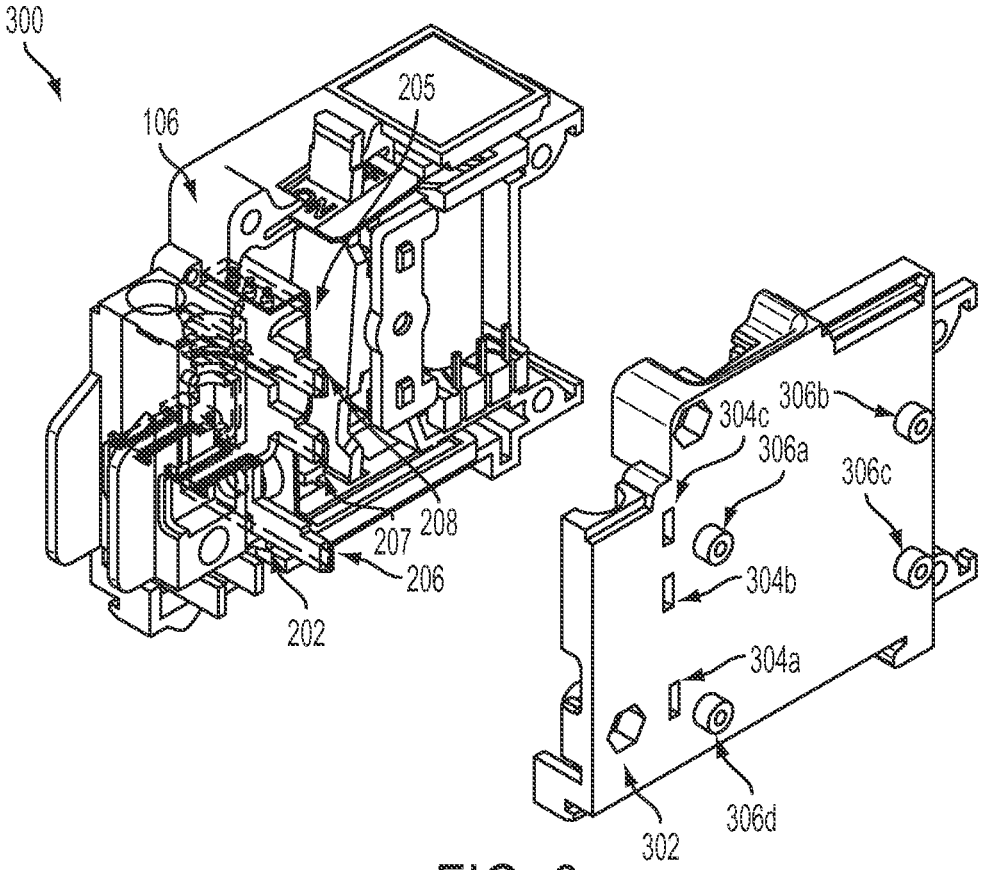
FIG. 6 is an exploded view depicting an example of a modular relay sub-assembly including the split conductor of FIGS. 5A and 5B.

FIG. 6 is an exploded view of a modular relay sub-assembly 300. The modular relay sub-assembly 300 can include the conductor 202, the split conductor 205, first housing portion 106, and second housing portion 302. The second housing portion 302 can define openings 304*a-c*. The terminals 206-208 can extend through the second housing portion 302 via the openings 304*a-c*. The terminals 206-208 extending through the second housing portion 302 via the openings 304*a-c* can maintain the terminals 206-208 in a stable position. The conductor 202 and the split conductor 205 can be positioned inside a casing provided by the first housing portion 106 and second housing portion 302. The second housing portion 302 can also include one or more threaded bosses 306*a-d* or protrusions. Additional auxiliary devices and/or modules can be attached or otherwise coupled to the modular relay sub-assembly 300 via the threaded bosses 306*a-d*.

Figure 7:
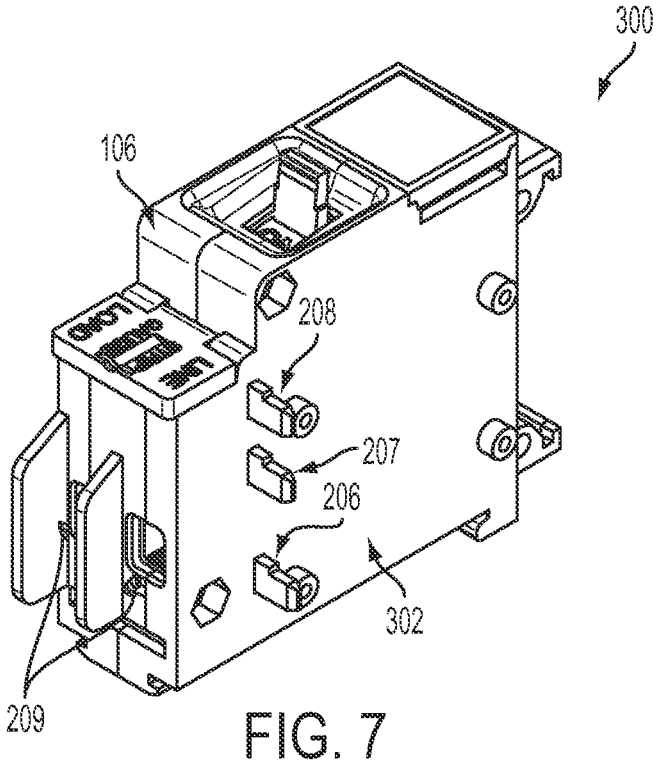
FIG. 7 is a perspective view depicting the relay assembly of FIG. 6 shown assembled.

FIG. 7 is a perspective view of the modular relay sub-assembly 300 as assembled. The conductor 202 and the split conductor 205 can be positioned between the first housing portion 106 and second housing portion 302 such that the terminals 206-208 respectively protrude from the openings 304*a-c*. The second housing portion 302 can define openings 304*a-c*. The assembly may include one or more openings 209 that provide access to the conductors, such as to contact 210 and/or contact 211.

Figure 8:
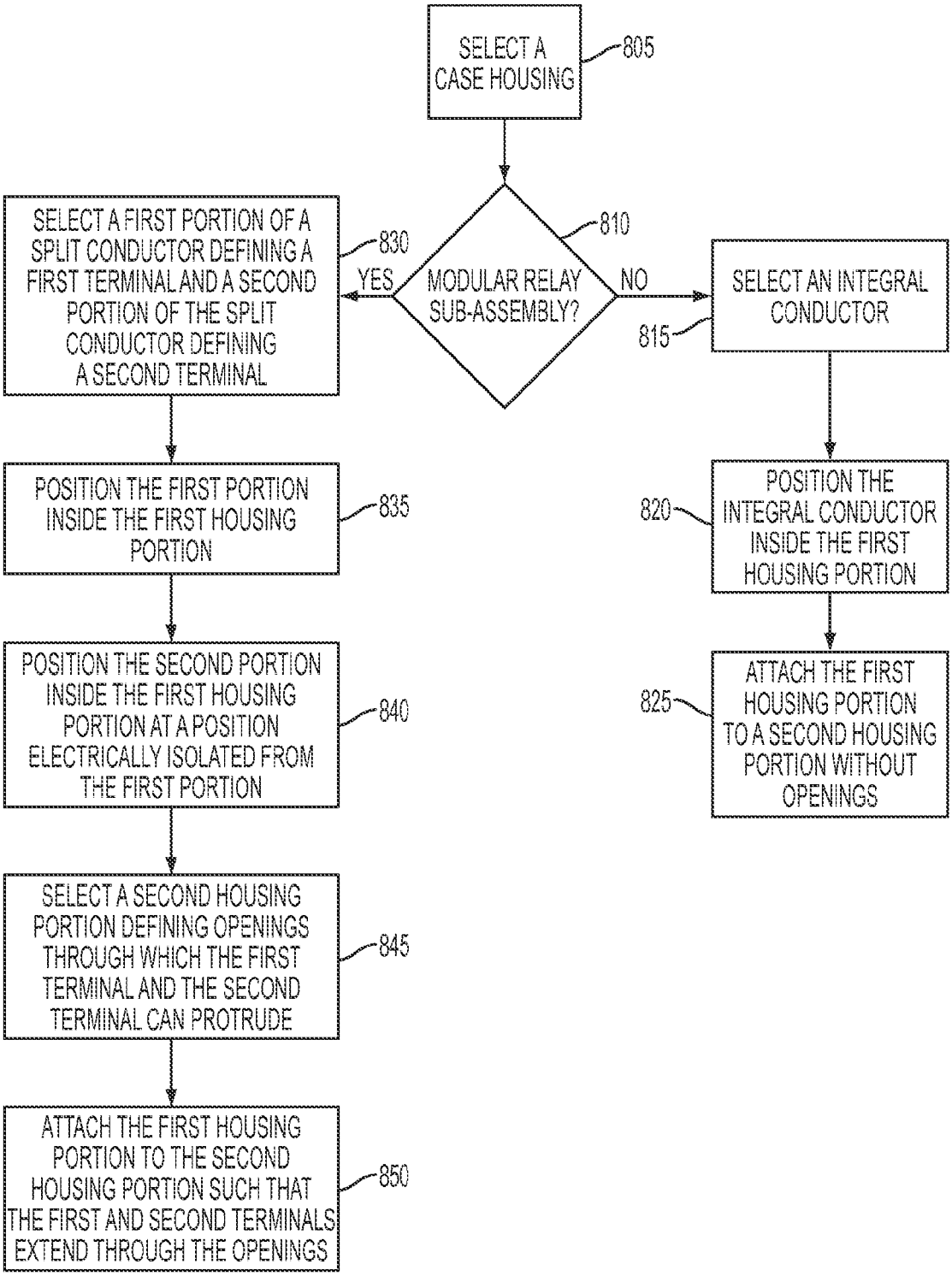
FIG. 8 is a flow chart depicting an example of a method for manufacturing a relay having a modular design.

Any suitable manufacturing process can be used to manufacture a relay having a modular design. For example, FIG. 8 is a flow chart illustrating an example of a method 800 for manufacturing a relay having a modular design according to some aspects.

The method 800 involves selecting a first housing portion 106, as shown in block 805.

The method 800 also involves determining whether a modular relay sub-assembly 300 is to be manufactured, as shown in block 810.

If a modular relay sub-assembly is not to be manufactured, the method 800 involves selecting an integral conductor 104 for manufacturing the relay assembly, as shown in block 815. The method 800 further involves positioning the integral conductor 104 inside the first housing portion 106, as shown in block 820. The method 800 further involves attaching or otherwise coupling the first housing portion 106 to a second housing portion 108 without openings 304*a-c*, as shown in block 825.

If a modular relay sub-assembly 300 is to be manufactured, the method 800 involves selecting a first portion 203 of a split conductor 205 defining a first terminal 207 and a second portion 204 of the split conductor 205 defining a second terminal 208, as shown in block 830.

The method 800 further involves positioning the first portion 203 inside the first housing portion 106 such that the first terminal 207 of the split conductor 205 extends outside the first housing portion 106, as shown in block 835.

The method 800 further involves positioning the second portion 204 inside the first housing portion 106 such that the second terminal 208 of the split conductor 205 extends outside the first housing portion 106, as shown in block 840. The second portion 204 is positioned inside the first housing portion 106 such that the second portion 204 is electrically isolated from the first portion 203 within the first housing portion 106. The first portion 203 and the second portion 204 may be located and/or secured within the first housing portion 106 using the one or more tangs 212.

The method 800 further involves selecting a second housing portion 302 defining openings 304*a-c* through which the terminals 207, 208 can protrude, as shown in block 845.

The method 800 further involves coupling or otherwise attaching the second housing portion 302 to the first housing portion 106 such that the first terminal 207 extends through a first opening (such as the opening 304*b*) and such that the second terminal 208 extends through a second opening (such as the opening 304*c*), as shown in block 850.

The split conductor 205 can allow current to be routed from the modular relay sub-assembly 300 to a device outside the second housing portion 302 via one or more of the terminals 206-208. Routing the current outside of the second housing portion 302 can allow the current to be modified for phase dimming and/or allow the current to be measured. The current can be routed from the device outside the second housing portion 302 to the relay inside the housing via another one or more of the terminals 206-208.

Using a split conductor 205 and routing current outside the housing of the relay assembly can allow a heat-generating element used as a sensing element (e.g., a resistor) to be positioned outside the relay housing. Using an external resistor may reduce manufacturing costs involved in manufacturing a relay.

The modular relay sub-assembly 300 can be used with any suitable application. For example, the modular relay sub-assembly 300 can be used with a control panel having an auxiliary device, such as a field installed module (such as, but not limited to, an XPoint® Module) that may be used to remotely switch loads. Loads can be switched remotely via a networking socket and/or a radio receiver. Such a control panel may include one or more auxiliary devices or additional add-on modules that can be used with the modular relay sub-assembly.

Figure 9A:
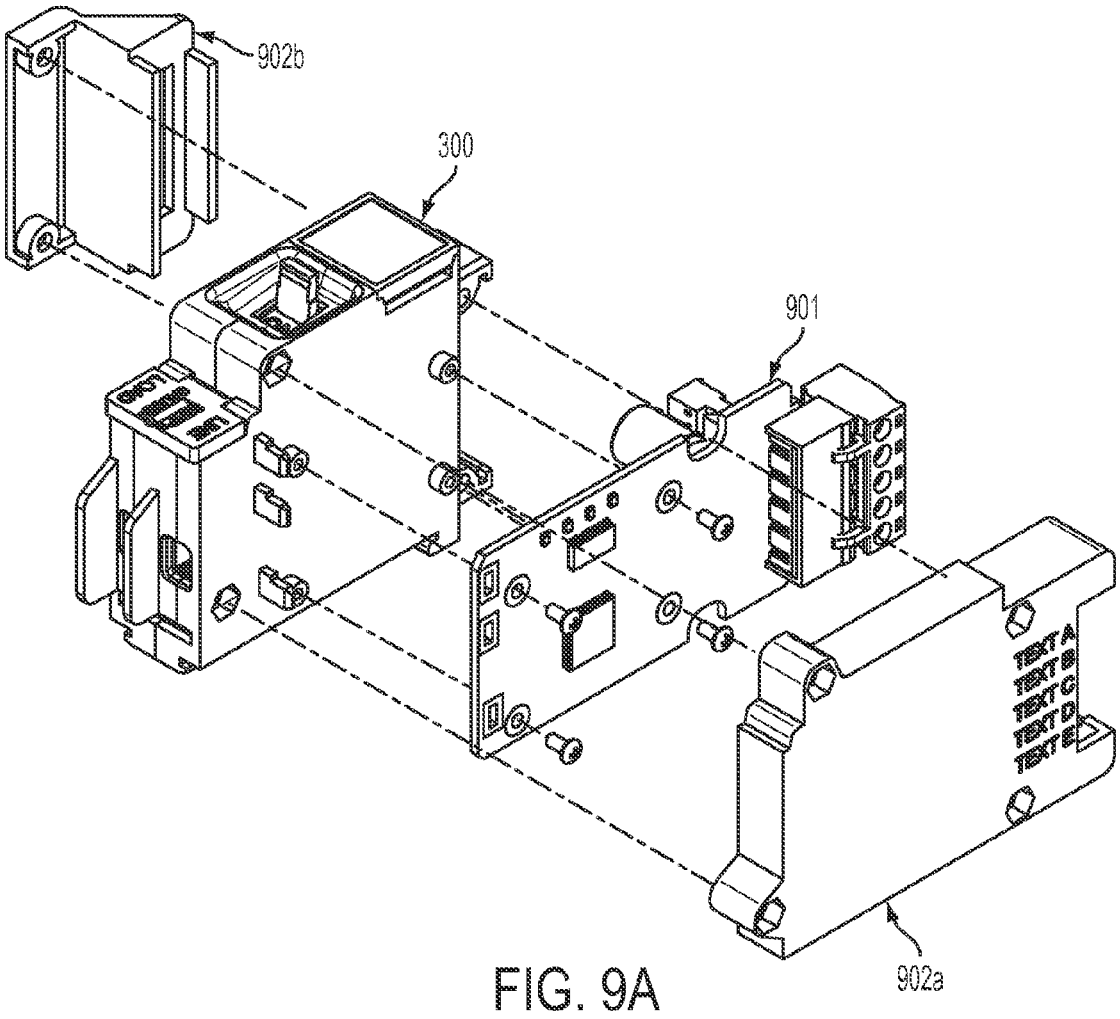
FIGS. 9A and 9B are exploded and assembled views, respectively, depicting a modular relay sub-assembly that includes an auxiliary device.
Figure 9B:
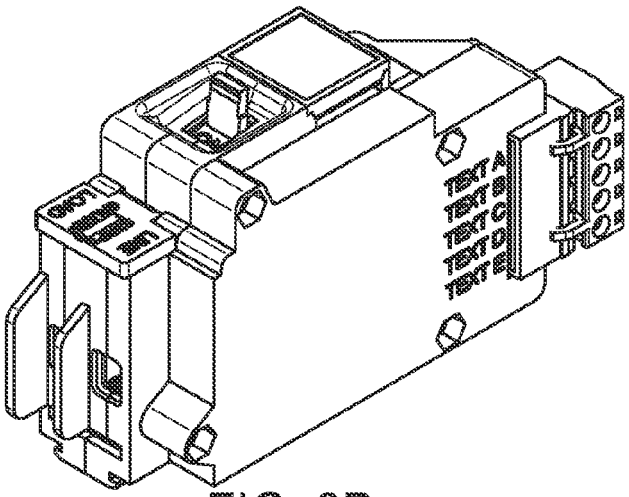

In some aspects, the modular relay sub-assembly can be connected or otherwise coupled to an auxiliary device 901, as depicted in FIGS. 9A and 9B. The auxiliary device 901 may be enclosed within an auxiliary device housing that includes a first portion 902*a* and a second portion 902*b*.

An example of the auxiliary device 901 is a current sensing device (e.g., a printed circuit board including one or more current sensing components that are attached or otherwise coupled to the printed circuit board). The current sensing device can be manufactured with one or more dimensions that allow terminals of the current sensing device to contact one or more of the terminals 206-208 provided by the split conductor 205. Positioning a sensing element of the current sensing device outside the housing of the modular relay sub-assembly can allow a sensing element to be selected for use that provides improved accuracy as compared to sensing elements used inside the housing of a relay assembly.

Figure 10A:
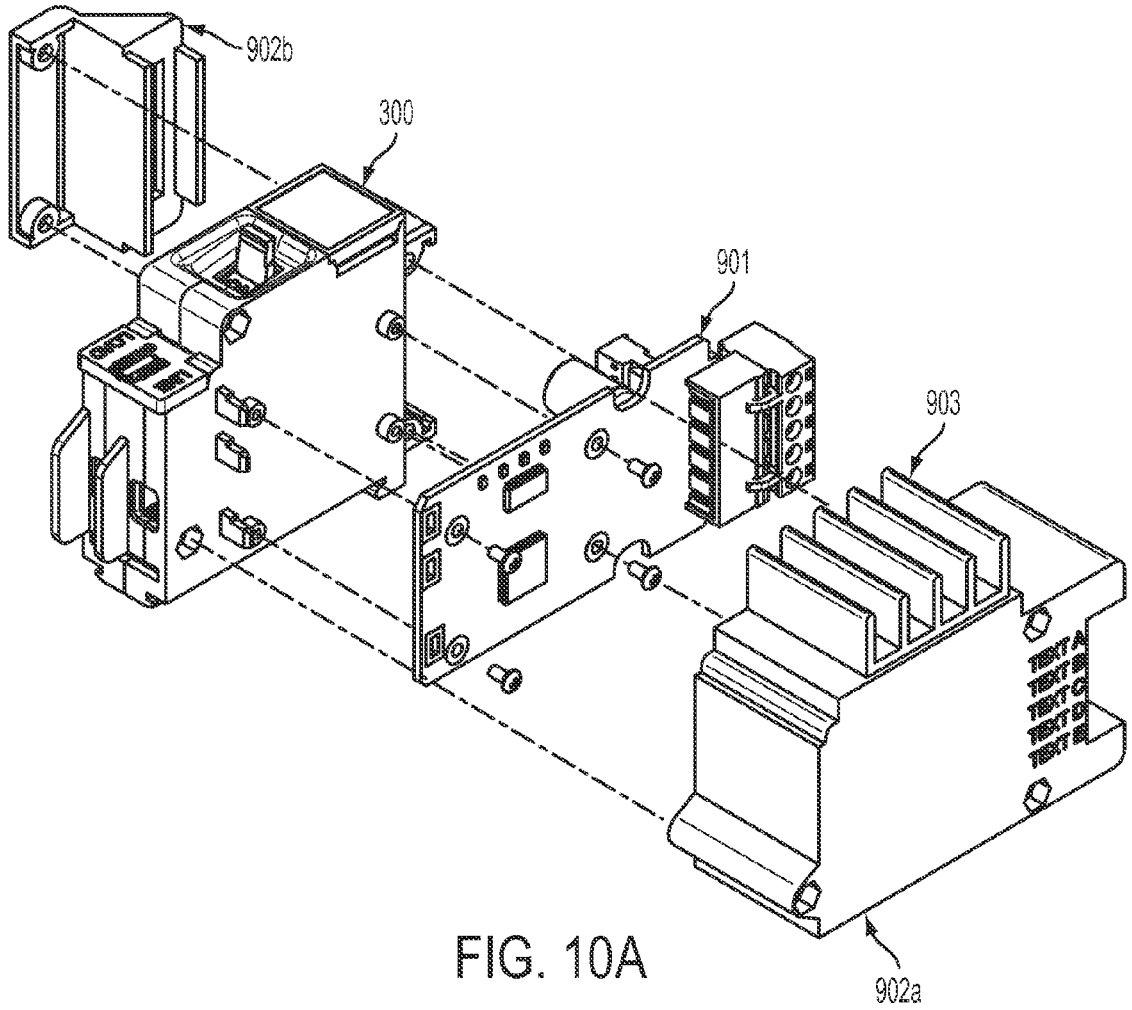
FIGS. 10A and 10B are exploded and assembled views, respectively, depicting a modular relay sub-assembly that includes with an auxiliary device with a heat sink.
Figure 10B:
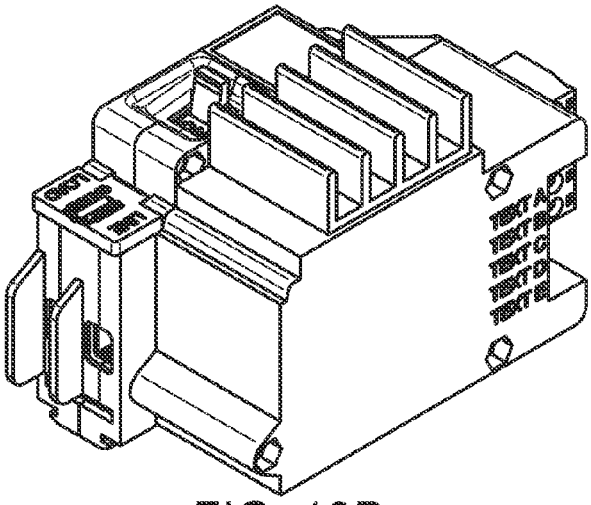

In other aspects, the modular relay sub-assembly 300 can be connected to another example of an auxiliary device 901 such as a dimming device, as depicted in FIGS. 10A and 10B. A dimming device can include components attached or otherwise coupled to a printed circuit board. The dimming device can be manufactured with such that the dimming device has one or more dimensions allowing terminals of the dimming device to contact one or more of the terminals 206-208. A dimming device may include a heat sink 903. Non-limiting examples of a dimming device include a 300-watt dimmer and a 600-watt dimmer. The auxiliary device 901 may be a current sensing device, a phase dimming device, or a 0-10V dimming device.

A dimming device may be wider than a current sensing device. For example, a current-sensing device may have a width that is 1.5 times the width of the modular relay sub-assembly and a dimming device may have a width that is twice the width of the modular relay sub-assembly.

In additional or alternative aspects, a power measurement device, a current-sensing device, and/or a dimming device coupled to the modular relay sub-assembly 300 can include a neutral wire or other neutral connection from the control card of the current-sensing device and/or the dimming device to the split conductor 205. One or more of the terminals 206-208 can extend from the relay. A control card of the auxiliary device can be positioned over one or more of the terminals 206-208. The control card can include a neutral connection that can be used for measuring a load voltage. One or more of the terminals 206-208 can be soldered to the control card.

The foregoing description of the examples, including illustrated examples, of the invention has been presented only for the purpose of illustration and description and is not intended to be exhaustive or to limit the invention to the precise forms disclosed. Numerous modifications, adaptations, and uses thereof will be apparent to those skilled in the art without departing from the scope of this invention. The illustrative examples described above are given to introduce the reader to the general subject matter discussed here and are not intended to limit the scope of the disclosed concepts. Aspects and features from each disclosed example can be combined with any other example. The terms "invention," "the invention," "this invention" and "the present invention" used in this patent are intended to refer broadly to all of the subject matter of this patent. Statements containing these terms should not be understood to limit the subject matter described herein.

What is claimed is:

1. A modular relay sub-assembly comprising:

a first housing portion;

a second housing portion attached to the first housing portion;

a conductor having a first contact, the conductor being disposed inside a cavity formed by the first housing portion and the second housing portion, wherein the first contact is accessible through a first opening in the first housing portion; and a split conductor having a first portion, a second portion, and a second contact, the split conductor being disposed inside the cavity formed by the first housing portion and the second housing portion such that the second portion is disposed at a position electrically isolated from the first portion, wherein the second contact is accessible through a second opening in the first housing portion and the split conductor is positioned to selectively contact the conductor.

2. The modular relay sub-assembly of claim 1, wherein the first portion of the split conductor includes a first terminal, the second portion of the split conductor includes a second terminal, and the conductor includes a third terminal.

3. The modular relay sub-assembly of claim 2, wherein at least one terminal of the first, second, and third terminals protrudes through at least one corresponding opening in the second housing portion such that the at least one terminal is oriented in a first direction that is perpendicular to a second direction in which the first and second contacts are oriented.

4. The modular relay sub-assembly of claim 1, wherein an outer surface of the second housing portion includes at least one threaded protrusion adapted to facilitate attachment of an auxiliary device.

5. The modular relay sub-assembly of claim 4, wherein the auxiliary device comprises at least one of a current sensing device, a phase dimming device, or a dimming device.

6. The modular relay sub-assembly of claim 4, further comprising:

an auxiliary device casing configured to enclose the auxiliary device, wherein the auxiliary device casing interfaces with the outer surface of the second housing portion.

7. The modular relay sub-assembly of claim 6, wherein the auxiliary device casing includes a heat sink.

8. The modular relay sub-assembly of claim 1, wherein the first portion of the split conductor includes a first extended portion and the second portion of the split conductor includes a second extended portion, wherein the first and second extended portions are adapted to secure the split conductor inside the cavity.

* * * * *